United States Patent [19]

Akrich et al.

[11] 4,302,628

[45] Nov. 24, 1981

[54] ANALOG SIGNAL ENCRYPTING AND DECRYPTING SYSTEM

[75] Inventors: Charles Akrich, Meudon; Jean C. Lemaire, Aulnay-sous-Bois; Michel J. Maillard, Ivry; Michel Ruiz, Paris, all of France

[73] Assignee: Etablissement Publre Telediffusion de France, Paris, France

[21] Appl. No.: 139,675

[22] Filed: Apr. 14, 1980

[30] Foreign Application Priority Data

Apr. 20, 1979 [FR] France ..... 79 10092

[51] Int. Cl.[3] ..... H04K 1/06

[52] U.S. Cl. ..... 179/1.5 S; 178/22.04; 179/1.5 R

[58] Field of Search ..... 179/1.5 R, 1.5 S, 15.55 T; 178/22

[56] References Cited

U.S. PATENT DOCUMENTS

| | | | |
|---|---|---|---|
| 3,773,977 | 11/1973 | Guanella | 179/1.5 S |
| 3,846,827 | 11/1974 | Eppler, Jr. | 179/15.55 T |
| 3,959,597 | 5/1976 | Keiser | 179/15.55 T |
| 4,099,027 | 7/1978 | Whitten | 179/1.5 S |
| 4,217,469 | 8/1980 | Martelli | 179/1.5 R |

*Primary Examiner*—Howard A. Birmiel

*Attorney, Agent, or Firm*—Abraham A. Saffitz

[57] ABSTRACT

An encrypting and decrypting system employing analog signals in which delay lines are employed in both the encrypter and decrypter so that the initial analog signal which is received may be switched by switching means to a writer means where encrypting occurs in a delay line in which stages are filled in a predetermind clock period. Another delay line similar to that used for the writer means and this other delay line is used for reading the written stages from the first delay line according to the predetermined time distribution. Decrypting is carried out by inverting the foregoing encrypting operations. Various types of cynchronization are shown. Both read and write controls are shown.

5 Claims, 6 Drawing Figures

ANALOG SIGNAL ENCRYPTING AND DECRYPTING SYSTEM

CROSS REFERENCES TO RELATED APPLICATIONS

Applicants hereby make cross references to their French patent application PV No. 79 10092, filed Apr. 20, 1980 and claim priority thereunder following the provisions of 35 U.S.C. 119.

BACKGROUND OF THE INVENTION

1. Field of the Invention

This invention relates to an encrypting and decrypting system for encrypting an incoming analog signal into an encrypted analog signal and for decrypting the encrypted analog signal into an decrypted analog signal which is analogous to the incoming signal.

More particularly, the invention concerns the encrypting and decrypting of an audiofrequency signal of a radiophonic program or, more generally, to the encoding and decoding, or scrambling and unscrambling, or enciphering and deciphering of an analog signal, thereby obtaining a non-intelligible signal to be transmitted from a station transmitter to listener receivers.

2. Description of the Prior Art

When a radio or television station wishes to broadcast a specific subject directed at a well-defined category of listeners, this program generally has to be broadcast at night, namely outside the public's peak listening hours. Since some listeners do not listen at night, automatic recording receivers may be provided which use a magnetophone or magnetoscope, to permit the hours of reception to be virtually independent of the listeners' program listening time.

However, when a specialized program is heard solely by a specialized class, such as doctors in the case of a medical program it may be undesirable for other people to listen in. In this case, the listeners are selected from encrypting the audiofrequency signal broadcast by the radio-communications or television transmitter in accordance with a "key" or encrypting code and by thereafter decrypting the audiofrequency signal picked up by the listener's receiver in accordance with the "key" or decrypting code corresponding to the inverse operation of the encrypting code operation. These encrypting and decrypting operations are made applicable to analog signals such as speech and musical signals.

Known encrypting and decrypting systems in the prior art implement an analog sampling of the incoming analog signal at periodic time intervals at predetermined instants. Thereafter there takes place a scrambling of the analog samples. Known methods of arithmetic encoding can be applied, the simplest ones consisting of an encoding in accordance with a pseudo-random sequence or with permutation sequences of two or several analog samples. An example is found in U.S. Pat. No. 4,100,374.

The U.S. Pat. No. 4,100,374 discloses an encrypting and decrypting system based on an analog sample permutation method. The delay means which is included in the encrypter (or the decrypter) of this patent comprises two analog shift registers each having N stages. The inputs of the first stages of the two shift registers receive N samples of the incoming signal to be encrypted (or the encrypted signal). Each of the two shift registers time delays of N incoming signal samples (or N encrypted signal samples) during every other period $NT_W$ of the encrypting signal (or the decrypting signal). The 2 N stage outputs of the two shift registers are connected to the output of the encrypter (or the decrypter) through an analog switch which is analogous to a parallel-to-series converter. The analog switch is controlled by the encrypting signal (or the decrypting signal) so as to select the N outputs of one of shift registers then the N outputs of the other shift register during two consecutive periods $NT_W$. During each time $NT_W$, the N outputs of a shift register are selected according to a predetermined encrypting sequence so as to transpose and read the previously written samples according to a various arrangement. This is equivalent to a permutation of samples which is synchronized at a reading frequency equal to the writing frequency $1/T_W$. The encrypting signal controls also the addressing of the N outputs of a shift register according to a predetermined permutation and at a constant reading frequency.

For reconstructing the initial signal in the decrypter, the decrypting signal is composed of a series of stage addressing words in according with the complementary permutation to the encrypting permutation. Consequently, the encrypting signal producing means and the decrypting signal producing means are both necessary. In addition, the fact that the addressing order of the outputs of shift registers according to a predetermined permutation differs from the initial order of the received signal samples, complicates the logic circuitry of the system. As a result of this arrangement, the cost of the system is relatively high, so that the number of the listeners who can afford a decrypter for specialized programs is reduced.

OBJECTS OF THE INVENTION

The principal object of this invention is to provide an encrypting and decrypting system overcoming the disadvantages of the prior art systems hereinabove described.

Another object of this invention is to provide an encrypting and decrypting system in which the initial order of the incoming signal samples is maintained in the encrypted signal.

A further object of this invention is to provide an encrypting and decrypting system in which the incoming signal samples undergo at least a time compression during each period of the key code signal and in which the encrypting and decrypting signals are identical. The time distribution of the samples in the encrypted signal fluctuates in a similar way without modifying the initial order of the samples.

SUMMARY OF THE INVENTION

In accordance with the objects of this invention, an encrypting and decrypting system comprises:

first analog means receiving said incoming signal for time delaying 2 N analog samples of said incoming signal:

first writing means for producing first clock pulses at a predetermined period $F_W$ which control the writing and sampling operations of N successive samples of said incoming signal in a first time delay means during a first period $NT_W$;

first reading means for producing an encrypting signal having N pulses per period equal to $NT_W$, said N encrypting signal pulses controlling the in series reading operation of said N successive samples of said incoming signal in said first time delay means during a second period $NT_W$ following said first period thereby obtaining said analog encrypted signal and said N encrypting signal pulses being time distributed according to a predetermined regular distribution in each of said periods $NT_W$ thereby obtaining N encrypted signal samples having undergone at least a time compression and eventually a time expansion with regard to the regular time distribution of said N incoming signal delayed samples;

second analog means receiving said encrypted signal for time delaying 2 N analog samples of said encrypted signal;

second writing means for producing a decrypting signal synchronized with and identical to said encrypting signal, the N decrypting signal pulses controlling the writing operation of the N successive samples of said encrypted signal in said second time delaying means during said first period $NT_W$ and said N decrypting signal pulses being distributed in time according to said predetermined distribution, and second reading means for producing second clock pulses at said predetermined period $T_W$ which are synchronized with said first clock pulses and control the reading operation of the N successive encrypted signal samples in said second time delaying means during said period $NT_W$ thereby obtaining said analog decrypted signal.

The delay or time compression and expansion function of the initial or encrypted signal is performed by means of two delay lines comprising analog shift registers such as charge transfer circuits (C.T.D.). Each delay line comprises N analog stages.

According to one embodiment of the invention, the inputs of the first stages of delay lines in the encrypter (or the decrypter) are connected to receive the initial (or encrypted) analog signal. The outputs of the last stages of the two delays lines are connected alternately to the output of the encrypter (or the decrypter) during half the encrypting (or decrypting) signal period via analog switching means. Each encrypting (or decrypting) signal period corresponds to the time taken to fill all the stages of a delay line during which the initial (or the decrypted) signal samples are written in the encrypter (or are read in the encrypter). During one period of the encrypting (or decrypting) signal, one of the two delay lines is write controlled in the encrypter at a predetermined clock period (or in the decrypter at N writing instants of the decrypting signal according to the predetermined time distribution), whereas the other delay line is read controlled in the encrypter at the N reading instants of the encrypting signal according to the predetermined time distribution (or in the decrypter at the predetermined clock period). The preceding read or write controls are inverted relative to the two delay lines during the following period of the encrypting (or decrypting) signal.

According to a second embodiment of the invention, in the encrypter (or the decrypter), the input of the first stage of a first delay line receives the initial (or encrypted) analog signal. The N stage outputs of the first delay line are connected in parallel to the N stage inputs of a second delay line, respectively.

The output of the second delay line is connected to the encrypter (or decrypter) output. During each encrypting (or decrypting) signal period, the first delay line is write controlled in the encrypter at the writing clock period (or in the decrypter at the N writing instants of the decrypting signal according to the predetermined time distribution), whereas the second delay line is read controlled in the encrypter at N reading instants of the encrypting signal according to the predetermined time distribution (or in the decrypter at the reading and sampling clock period). The first and second delay lines are simultaneously read and write controlled at the end of each encrypting (or decrypting) signal period for transferring in parallel the N analog samples from the first to the second delay line.

The means for producing in synchronism the encrypting and decrypting code signals which are identical may be based on the pulse modulation of a predetermined signal. This modulation may be of the position or frequency type and the frequency of the modulation signal can also be programmable. According to another aspect of the invention, the encrypting and decrypting signal producing means may be a programmable frequency multiplier or divider. The selection of these various means and the programmable frequency makes it possible to generate a plurality of key codes, each of which being assigned to a specialized program. Since, in general, the pulse modulation produces a number of pulses greater than the number of the analog samples during one period of the encrypting or decrypting signal, a counter counts the N first pulses of the code signal at the start of each period and locks the transmission of the following pulses until the start of the following period. Consequently, N samples of the encrypted signal are always time compressed during a period $NT_W$ of the encrypting signal. Nevertheless, the time between two successive encrypted signal samples included in a same period $NT_W$ may be more than the sampling period $T_W$. As a function of the selected modulation, the encrypted signal samples in a period $NT_W$ may be followed by a silent interval equal to at least one or several periods $T_W$.

Furthermore, it will be noted that the encrypted signal is appropriate to be conveyed by a communication medium between the encrypter and the decrypter which may be by cable, Hertzian channel, optical fibres, direct broadcast, such as via satellite, or by any other type of broadcasting means and that the decrypted signal always presents correct listening quality characteristics.

BRIEF DESCRIPTION OF THE DRAWING

The objects and advantages of this invention will become apparent as the following description of preferred embodiments of the invention as illustrated in the accompanying drawing, in which.

DESCRIPTION OF THE PREFERRED EMBODIMENTS

Figure 1:
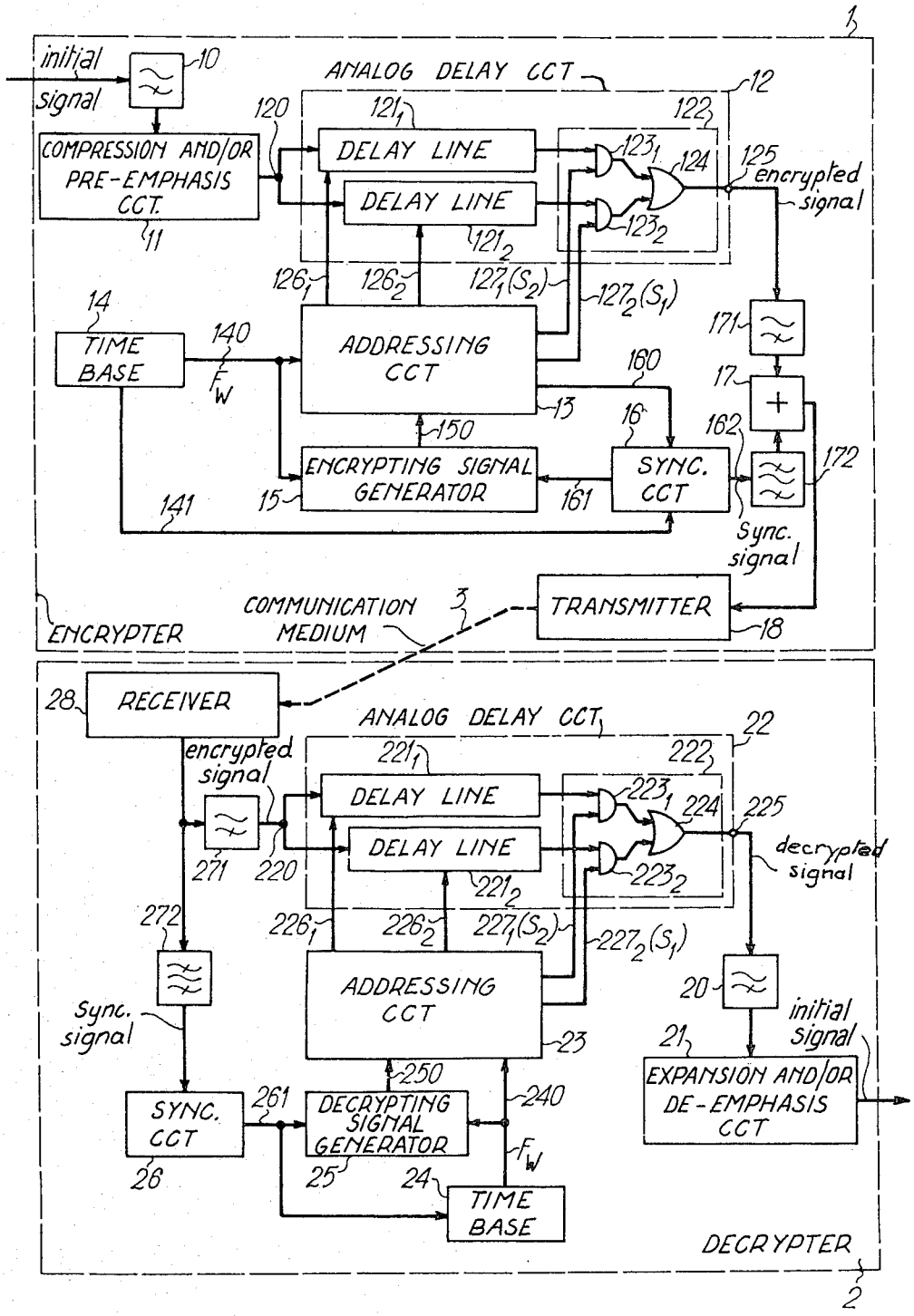
FIG. 1 is a block diagram of an encrypting and decrypting system including a delay line arrangement according to the first embodiment.

FIG. 1 shows an encrypting and decrypting system embodying the invention. It comprises an encrypter 1 for emission and a decrypter 2 for reception. The output of the encrypter 1 is linked to the input of the decrypter 2 by a communication medium 3.

The input of the encrypter 1 receives the initial analog signal to be encrypted. This is a speech and/or musical signal which is transmitted by a microphone or the audio tape of a magnetic tape recorder included in a radio or television station studio recording equipment for example. A low pass filter 10 filters the initial analog signal in a low frequency band which stretches, for example, up to 8 KHz. The filtered signal may be transmitted to a compression and/or pre-emphasis circuit 11 whose output is connected to the input 120 of an analog delay circuit 12. The circuit 11 contributes towards improving the performance of the encrypter by masking any possible defects due to sampling and switching inherent in encrypting. The signal/noise ratio is also increased as a result of the circuit 11.

According to a first embodiment, the analog delay circuit 12 is made up of two analog delay lines $121_1$, $121_2$ which are connected in parallel, and an analog switching circuit 122. The common inputs 120 of the analog delay lines $121_1$, $121_2$ are connected to the output of the compression and/or pre-emphasis circuit 11. The outputs of the last stages of the lines $121_1$, $121_2$ are connected to the two analog inputs of analog AND gates $123_1$ and $123_2$, respectively which are included in the switching circuit 122. The other inputs of the AND gates $123_1$ and $123_2$ receive two additional reading signals $S_2$ and $S_1=\overline{S}_2$, respectively which are transmitted on wires $127_1$ and $127_2$ from a write and read addressing circuit 13 so as to open the gates $123_1$, $123_2$ consecutively for a duration $NT_W$. This duration $NT_W$ is equal to the period of the encrypting and decrypting signals. The outputs of the analog AND gates $123_1$ and $123_2$ are connected to the inputs of an analog OR gate 124 whose output 125 transmits the encrypted signal.

The two delay lines $121_1$ and $121_2$ are identical and each delays the initial analog signal by a duration $NT_W$. In accordance with the invention, each analog delay line is a charge transfer integrated circuit or is composed of several charge transfer integrated circuits which are connected in series.

Although reference is made hereinafter to such a series connection, the charge transfer circuits of a delay line can be connected in parallel or in series-parallel. These integrated circuits are known under the abbreviation C.T.D. (charge transfer device) and are of known type under the initials B.B.D. (bucket-brigade device). For example, each analog delay line $121_1$ $121_2$ includes P analog shift registers. Each register is made up of 512 series stages of B.B.D. type. The operation of an analog register is such that, at each period $T_W$ which controls the writing-in of a sample in the encrypter, which is equal for example to 0.05 ms and which is transmitted in the form of a clock signal having a steady frequency $F_W=1/T_W$ on the respective wire $126_1$, $126_2$ by a time base 14 through the addressing circuit 13, a sample of the initial analog signal sampled at the input 120 is shifted by two stages towards the output of the delay lines $121_1$, $121_2$. Consequently, the delay introduced by a 512-stage register is equal to $512\times0.05/2$ ms. Each delay line delays the analog signal by a time lapse which is less than twice the writing duration $NT_W=(P\times512/2)\times0.05$ ms for writing N samples, and which depends on the reading frequency, namely on the selected encrypting code as will be seen hereinafter.

Figure 2:
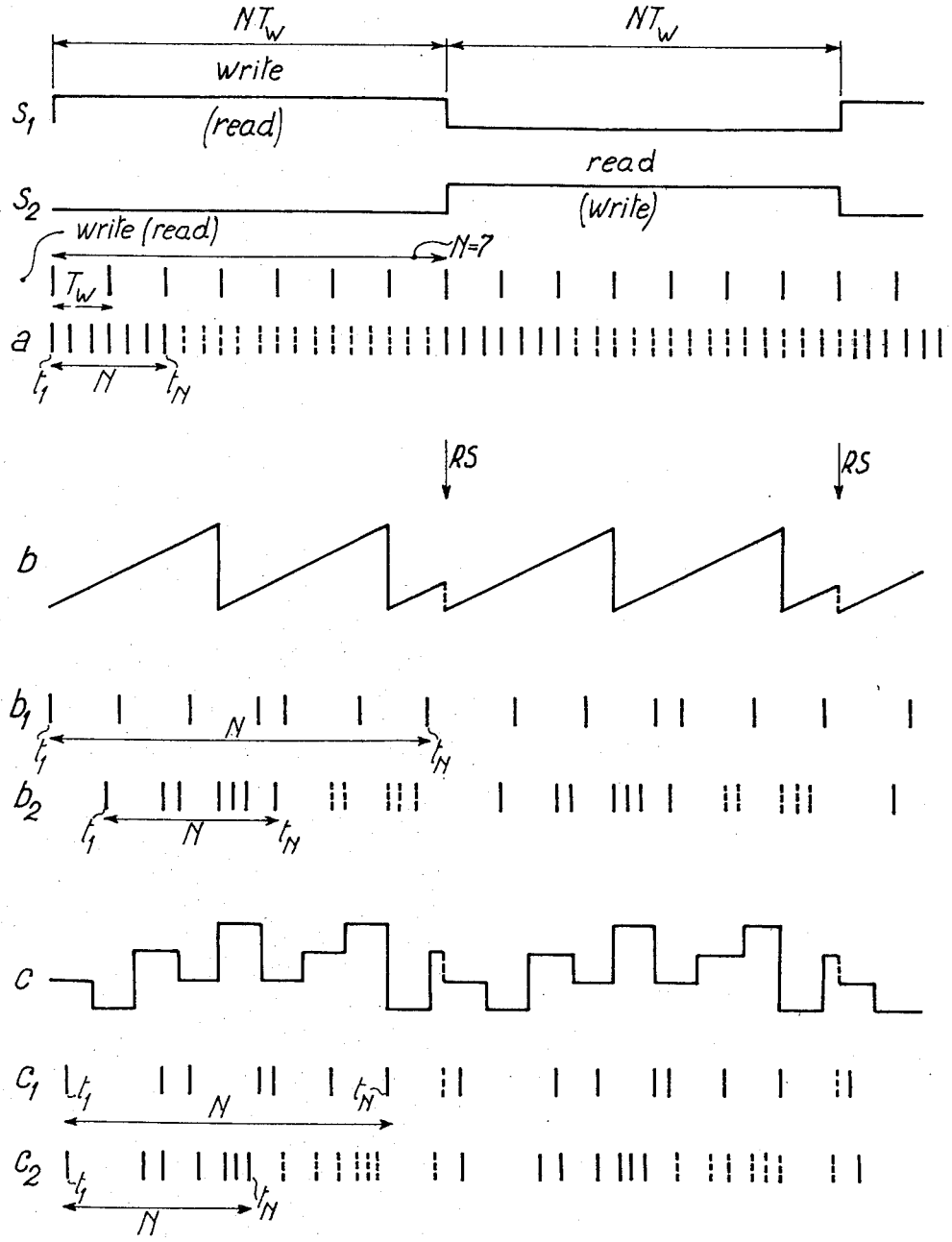
FIG. 2 shows waveforms useful in illustrating the reading and writing operations of the delay lines.

As shown in FIG. 2, the complementary reading (or writing) control signals $S_1$ and $S_2$ transmitted from the addressing circuit 13 to the AND gates $123_2$ and $123_1$ have a period equal to 2 $NT_W$. The pulse signals transmitted on the output wires $126_1$ and $126_2$ from the addressing circuit control the step-by-step advance of a sample in the delay lines in reading phase and also have a period equal to 2 $NT_W$. One of these, such as that on the wire $126_1$, is composed during a first half-period $NT_W$ by N pulses having the constant period $T_W$ which control the sampling and writing in the delay line $121_1$. During the following second half-period $NT_W$, it is composed by N pulses which control the reading of N written samples in the delay line $121_1$ and which are not equidistributed in time. In other words, the reading pulses have a time distribution which is determined by the encrypting key and different from the regular time distribution of the above writing pulses. The other pulse signal on the wire $126_2$ is composed during the above first half-period $NT_W$ by N pulses according to said determined time distribution which control the reading of N samples in delay line $121_2$, and is composed during the second above half-period $NT_W$ by N pulses which are equidistributed at constant period $T_W$ and which control the writing-in of N samples in the delay line $121_2$.

It appears that under the control of addressing circuit 13, when the first delay line $121_1$ is in writing operation during a reading half-period $NT_W$ for which the samples of the incoming initial signal advance at the writing period $T_W$, the second delay line $121_2$ is in reading operation for which the samples of the incoming initial signal, previously delayed, advance at successive instants $t_1$ to $t_N$ which are distributed as per the encrypting code signal during the same half-period $NT_W$. During the following half-period $NT_W$, the previous reading and writing operations are inverted: the first delay line $121_1$ is in reading operation and the second delay line $121_2$ is in writing operation.

The successive reading instants $t_1$ to $t_N$ are formed as per an encrypting code or key which is selected by an encrypting signal generator 15 and which may be dependent on the clock signal at frequency $F_W$ on the wire 140. The generator 15 transmits the reading pulses at the instants $t_1$ to $t_N$ during each time $NT_W$ to addressing circuit 13, via a bus 150. A synchronization circuit 16 receives from two output wires 160 of the addressing circuit 13 the complementary reading and writing control signals $S_1$ and $S_2$ for producing synchronizing pulses at the frequency $NT_W$ which allow appropriate restoration of the initial signal based on the encrypted signal in the decrypter 2. The synchronizing pulses are transmitted along a wire 161 towards the encrypting generator 15 and are appropriately modulated by a high-frequency signal transmitted, via the output wire 141 of the time base 14, to give a synchronizing signal at the output 162 of the circuit 16.

The encrypted signal and the synchronizing signal are mixed in a mixing unit 17 after respectively passing through a low pass filter 171 which is analogous to the filter 10, and a pass band filter 172 whose pass band is centered on the synchronization modulation frequency. The composite signal delivered from the output of the mixing unit 17 may be transmitted and appropriately shaped in a transmitter 18 which depends upon the transmission mode of the communication medium 3 between the encrypter 1 and the decrypter 2.

Upon reception in the decrypter 2, the composite signal may pass through an appropriate demodulating receiver 28 and is then filtered. A low pass filter 271 which is analogous to the filter 10, and a band pass filter 272 which is analogous to the filter 172, restore the encrypted signal and the synchronizing signal, respectively.

The decrypter 2 performs the inverse function of the encrypter 1 and comprises, in a similar way to the encrypter circuits 12 to 16, circuits 22 to 26. An analog delay circuit 22 receives the encrypted signal transmitted from the low pass filter 271 via its input 220 and restores via its output 225 the decrypted signal which is analogous to that applied to the input 120 of the analog delay circuit 12 of the encrypter 1. A write and read addressing circuit 23 controls analog delay lines $\mathbf{221}_1$ and $\mathbf{221}_2$ of the circuit 22 in writing and reading operating alternately, via wires $\mathbf{226}_1$ and $\mathbf{226}_2$. The addressing circuit 23 also controls the opening of analog AND gates $\mathbf{223}_1$ and $\mathbf{223}_2$ of an analog switching circuit 222 which is included in the circuit 22, alternately during reading, via wires $\mathbf{227}_1$ and $\mathbf{227}_2$. The circuit 222 is identical to the circuit 122 and also comprises an analog OR gate 224 whose output 225 delivers the decrypted signal. A time base 24 transmits a clock signal at constant frequency $F_W$ along a wire 240 to the addressing circuit 23 and a decrypting signal generator 25. The generator 25 previously records the decrypting code or key which is, in accordance with the invention, identical to the selected encrypting code, and transmits the writing pulses at variable non-equidistributed instants $t_1$ to $t_N$ to the addressing circuit 23 along a wire 250. The synchronizing pulses are detected in a synchronization circuit 26 making use of the synchronizing signal which is delivered from the filter 272, and are transmitted along a wire 261 to the generator 25 and the time base 24. The synchronizing signal also makes it possible to control the advance of the listener's recording equipment, such as the recording tape of a magnetophone for example (not shown).

The analog decrypted signal, analogous to the initial analog signal received by the input 120 of the delay circuit 12 in the encrypter 1, is transmitted from the output 225 of the analog switching circuit 222 to a low pass filter 20 which is analogous to the filter 10, and may be transmitted to an expansion and/or de-emphasis circuit 21 which is complementary to the circuit 11. The output of circuit 21 is common with that of the decrypter 2 and restores a decrypted analog signal which is analogous to the initial analog signal received at the input of the encrypter 1.

Figure 3:
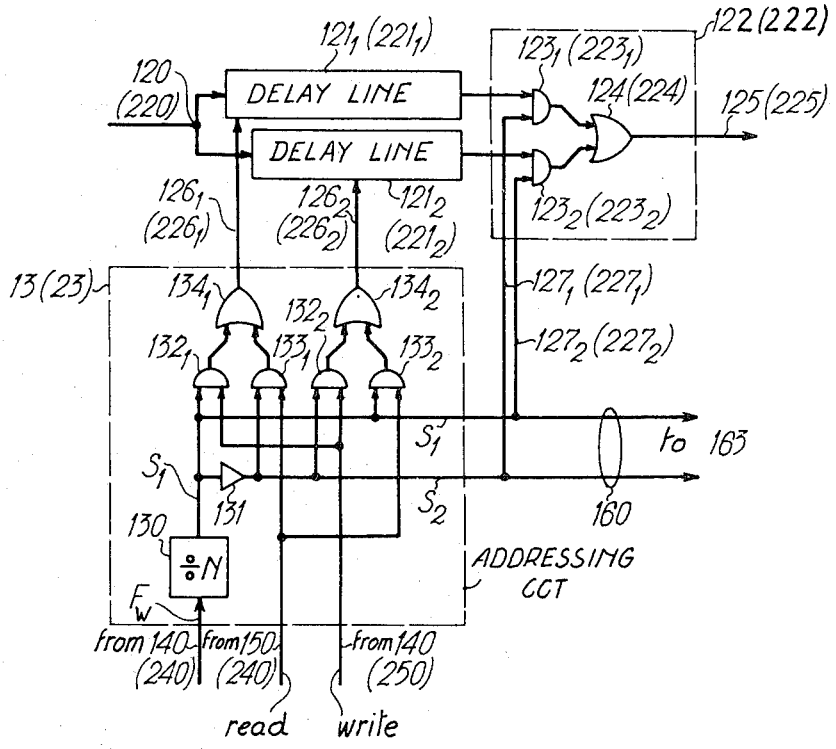
FIG. 3 is a block diagram of the addressing circuit according to the first embodiment.
Figure 4:
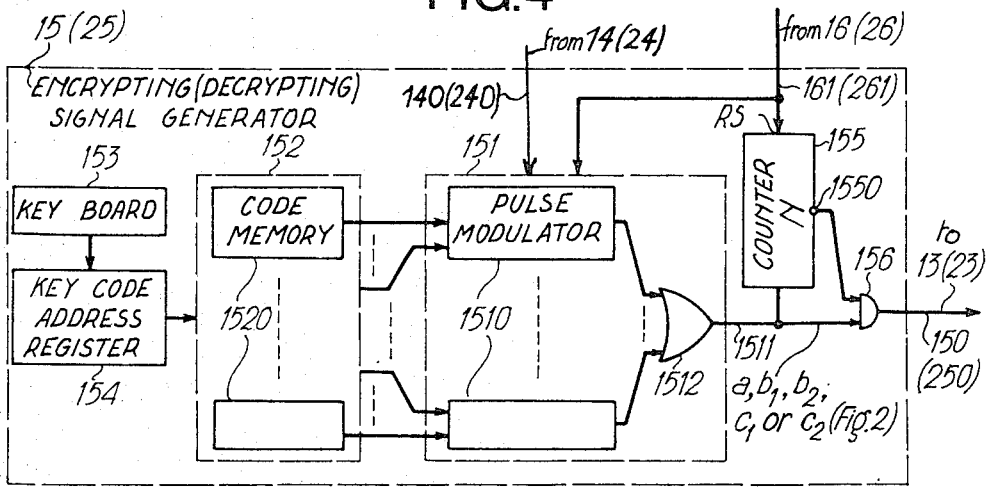
FIG. 4 is a block diagram of the encrypting signal generator or the decrypting signal generator.

Referring to FIGS. 3 and 4, a detailed description will be given of the formulation of the initial signal encryption by means of the addressing circuit 13 and the encrypting signal generator 15.

As already stated, the generator 15 produces N reading pulses at instants $t_1$ to $t_N$ such that, in general, $t_{i+1}-t_i \neq T_W$, with $1 \leqq i > N$. The time distribution of N reading pulses over a reading interval $NT_W$ is achieved by means of a so-called pulse modulation circuit 151. The circuit 151 can include one or several "pulse modulators" or "variable-step reading clocks" 1510 which are programmable or not and each of which generates a sequence of reading pulses during $NT_W$.

In accordance with a first embodiment, a modulator 1510 is a programmable frequency multiplier or divider which multiplies or divides a reference frequency. For example, the frequency $F_W$ transmitted by the time base 14 along the wire 140 may be multiplied by a predetermined integer Q. In this case, the N reading pulses are at frequency $Q \times F_W$, as illustrated on line a of FIG. 2, for $Q=3$. In accordance with a second embodiment, a modulator 1510 is a "pulse modulator" of a signal which is periodic or otherwise, and which has preferably a simple envelope. This signal may be a periodic sawtooth signal as illustrated on line b of FIG. 2 or a multi-level periodic signal as illustrated on line c of FIG. 2. Such signal is produced by a signal generator included in the modulator 1510. The modulation circuit included in the modulator 1510 operates according to one of the known pulse modulations. If the modulation is a position modulation, i.e. if the time positions of the pulses are proportional to the modulating signal amplitude, the reading pulses are distributed as illustrated by lines $b_1$ and $c_1$ of FIG. 2. When the modulation is a frequency modulation, pulse sequences at predetermined frequencies correspond to the predetermined amplitude values of the modulating signal, as illustrated on lines $b_2$ and $c_2$ of FIG. 2. It will be noted that other "pulse modulators" 1510 can easily be made by those skilled in the art and can result in the combination of the above embodiments. In particular, saw-tooth or multilevel type modulators can have the frequency of the modulation signal which is programmable. In general, the encrypter and, above all, the decrypter will comprise one or several "pulse modulators" which make it possible for each to generate an encrypted signal which is practically incomprehensible.

According to the invention and independently of the selected modulation type, the read samples in the encrypter 1 undergo always a time compression since all the written samples in the analog delay lines $\mathbf{121}_1$, $\mathbf{121}_2$ are read and transmitted. In other words, the time interval $(t_N-t_1)$ is always less than the period $NT_W$ of the encrypting signal. Nevertheless, a time expansion may be present between two samples i, j of a period $NT_W$; that is equivalent to $t_j-t_i>(j-i)T_W$. Such a time expansion is illustrated in FIG. 2 at line $c_1$ between the instants $t_2$ and $t_1$ or $t_4$ and $t_3$ and at line $c_2$ between the instants $t_2$ and $t_1$, although $(t_N-t_1)<NT_W$ is always satisfied.

The pulse modulators and/or the frequencies of the modulating signal of the latter are addressed by a read-only memory of encrypting key codes 152 which is included in the generator 15 shown in FIG. 4. Each cell 1520 of the memory 152 contains the address of a modulator 1510 and, if necessary, of one of the modulation frequencies. The code memory 152 is addressed, in a known manner, in reading by an alphanumeric keyboard, via a key code address register 154 which contains the address of a cell 1520 of the memory 152 in correspondence with each number identifying an encrypting key which is transmitted from the key board 153. When an encrypting code is selected, the addressed pulse modulator 1510 is energized and produces the reading pulses at the predetermined instants $t_1$ to $t_N$ at the output 1511 of the pulse modulation circuit 151, via an OR gate 1512.

However, for the N samples written previously in a delay line $\mathbf{121}_1$, $\mathbf{121}_2$ to be only read during following time $NT_W$, the other pulses of a rank greater than N must be inhibited during this time. Moreover, it will be noted that the modulation frequency and the modulation procedure of each modulator 1510 are chosen in such a way that at least N reading pulses are transmitted to the output 1511 during $NT_W$ so as to transmit the initial sampled signal without data loss. With this in mind, the encrypting signal generator 15 comprises a counter 155 having maximum capacity N whose counting input is connected to the output 1511 of the pulse modulation circuit 151, and an AND gate 156 whose inputs are connected to the output 1550 of the counter 155 and to the terminal 1511. The counter 155 is reset to zero (RS) each time it receives a synchronizing pulse which is transmitted along the wire 161 from the synchronization circuit 16 and which defines a transition between the reading and writing operatings of duration $NT_W$ relative to each delay line. Once the count of the counter 155 reaches value N, the counter 155 delivers a signal at its output 1550 which closes the AND gate 156 until the next zero setting, such that only N reading pulses pass through the AND gate 156 during a time $NT_W$. The N transmitted reading pulses are illustrated by full lines on lines $b_1$, $b_2$, $c_1$ and $c_2$ of FIG. 2, whereas the following pulses which are inhibited, are illustrated by dotted lines. If the selected modulator 1510 has a modulation signal whose frequency is not an integer multiple of frequency $1/NT_W$, the synchronizing pulse on the wire 161 is also transmitted to the selected modulator 1510 for it to be triggered at the start of each reading and writing operation of duration $NT_W$ so as to produce a modulation signal having a period $NT_W$, as illustrated in lines b and c of FIG. 2.

The addressing circuit 13 is shown in FIG. 3. It produces the signals $S_1$ which simultaneously controls the writing operation setting of the delay line $121_1$ and the reading operation setting of the other delay line $121_2$. The addressing circuit 13 also produces the signal $S_2$ which controls the reading operation setting of the delay line $121_1$ and the writing operation setting of the other delay line $121_2$. The signal $S_1$ is applied at the output of a divide-by-N frequency divider 130 whose input receives the writing pulses at the constant frequency $F_W$ which are provided from the time base 14 on the wire 140. The complementary signal $S_2=\overline{S}_1$ is delivered from the output of an inverter 131 whose input is connected to the output of the frequency divider 130.

The addressing circuit 13 also comprises two identical logic circuits which enable the alternate transmission of writing pulses and the reading pulses to the delay lines $121_1$, $121_2$. Each logic circuit is made up of a first AND gate $132_1$, $132_2$ which controls the writing and sampling in the delay line $121_1$, $121_2$, a second AND gate $133_1$, $133_2$ which controls the reading in the delay line $121_1$, $121_2$ and an OR gate $134_1$, $134_2$ whose inputs are connected to the outputs of first and second AND gates $132_1$, $133_1$ or $132_1$, $133_2$ and whose output controls the advance of initial signal samples in the delay line $121_1$, $121_2$, via the wire $126_1$, $126_2$. Two common inputs of the AND gates $132_1$ and $133_2$ receive the signal $S_1$ which also controls the opening of the analog AND gate $123_2$ of switching circuit 122, via the wire $127_2$. Two common inputs of the AND gates $133_1$ and $132_2$ receive the signal $S_2$ which also controls the opening of the analog AND gate $123_1$ of the switching circuit 122, via the wire $127_1$. The other inputs of the writing and sampling gates $132_1$ and $132_2$ receive, via the time base outputting wire 140, the writing pulses at the constant frequency $F_W$ and alternately control the sampling and writing of the initial signal in the delay lines $121_1$ and $121_2$ during successive periods $NT_W$. The other inputs of reading gates $133_1$ and $133_2$ receive, via the output wire 150 from the generator 15, the reading pulses and alternately control the reading and transmission of the encrypted signal from the delay lines $121_1$ and $121_2$ during successive periods $NT_W$, via the analog AND gates $123_1$ and $123_2$ which are opened alternately and in correspondance with the opening of the AND gates $133_1$ and $133_2$.

Figure 5:
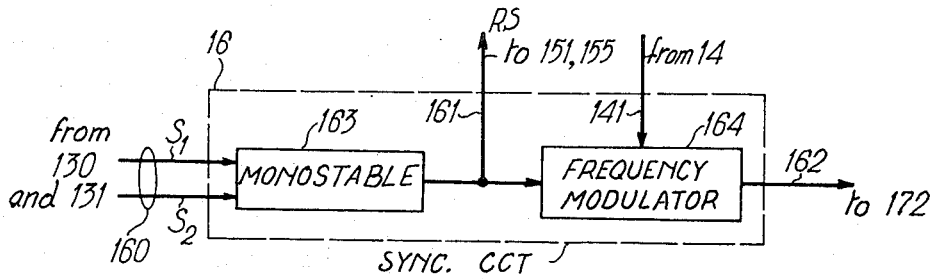
FIG. 5 is a block diagram of the synchronization circuit of the encrypter.

The synchronization circuit 16 is schematically illustrated in FIG. 5. It comprises a dual monostable flip-flop 163 which transmits a synchronizing pulse on the wire 161 at each rise front of the complementary signals $S_1$ and $S_2$, i.e. at the beginning of each time interval $NT_W$. In this respect, the inputs of the flip-flop 163 are connected to the outputs of the divider 130 and the inverter 131, via the two-wire bus 160. The synchronization circuit 16 also comprises a frequency modulator 164 whose input is connected to the output of the flip-flop 163 and whose output applies the synchronizing signal along the wire 162 to the input of the band pass filter 172. The modulator 164 modulates in phase the synchronizing pulse at a subcarrier frequency of 15 kHz which is transmitted from the output wire 141 of the time base 14. As already stated, this modulated synchronizing pulse is mixed with the encrypted signal in the mixing unit 17 of the encrypter 1 and is detected in the synchronization circuit 26 of the decrypter 2.

On FIGS. 3 and 4, it can be seen that the addressing circuits 13, 23 and the generators 15, 25 in the encrypter 1 and decrypter 2 have identical block-diagrams, respectively. Reference numbers are indicated in brackets and correspond to the blocks and wires of the decrypter 2 shown in FIG. 1. The synchronization circuit 26 of the decrypter 2 is essentially made up of a frequency demodulator whose output 261 applies the synchronizing pulses to the zero-resetting input RS of counter 155 and possibly to the triggering input of certain pulse modulators 1510 of the decrypting signal generator 25. The synchronizing pulses are also received into the time base 24 for phasing the phase locking loop it contains at the frequency $F_W$.

When the listener wishes to record the specialized program corresponding to the selected encrypted code, he types the same identification key on the key board 153 of the decrypter 2 which causes through the key code address register 154 and the code memory 152 of the decrypter, the addressing and energizing of the corresponding modulator 1510 and, if the latter is frequency programmable, the selection of a frequency for the modulating signal. The selected modulator 1510 in the decrypter is identical to that selected in the encrypter. Indeed, the decrypter must recognize the samples which are transmitted by the encrypter at successive reading instants $t_1$ to $t_N$ after each beginning of a writing interval $NT_W$. Consequently, in the decrypter, the writings of the encrypted signal in the analog delay lines $221_1$ and $221_2$ during successive time intervals $NT_W$ must be identical upon reading the samples in the delay lines $121_1$ and $121_2$ of the encrypter. The reading in the decrypter 2 is identical to the writing in the encrypter 1 and is rhythmed at the constant frequency $F_W$. As shown in FIG. 3, as regards the addressing circuit 23 of the decrypter 2, the writing AND gates $132_1$ and $132_2$ receive the time non-equidistributed writing pulses in accordance with the encrypting code which are delivered from the output 250 of the decrypting signal operator 25, whereas the reading AND gates $133_1$ and $133_2$ receive the reading pulses at the constant frequency $F_W$ which are delivered from the output 240 of the time base 24.

Furthermore, since the synchronization circuit 26 synchronizes, via the wire 261, the emissions of the writing pulses which are transmitted from the selected pulse modulator 1510 and the reading pulses which are transmitted from the time base 24, the chopping of the encrypted signal and the restoration of the initial signal in the decrypter 2 are controlled in synchronism with the sampling and the reading of the initial signal in the encrypter 1.

Figure 6:
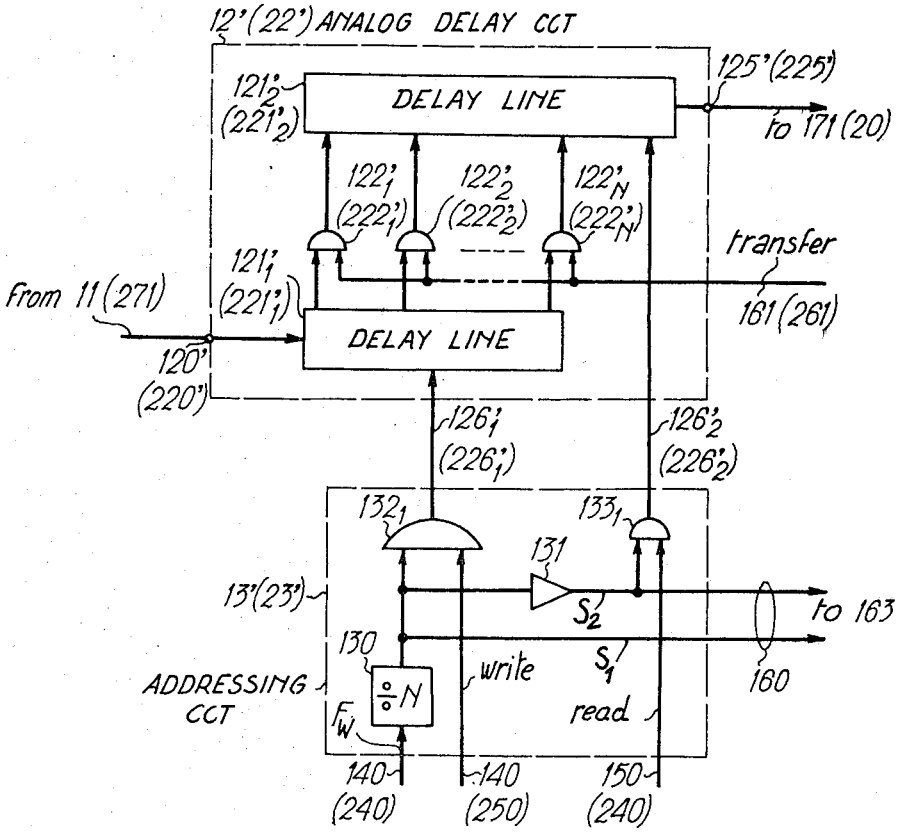
FIG. 6 is a block diagram of the analog delay circuit and the addressing circuit included in the encrypter or the decrypter according to the second embodiment.

In accordance with a second embodiment illustrated in FIG. 6, two analog delay lines $121'_1$, $121'_2$, of the delay circuit 12 in the encrypter 1 and two analog delay lines $222'_1$, $222'_2$ of the delay circuit 12' in the decrypter 1 are intended for the writing and reading operations, respectively. In FIG. 6, reference numbers are in brackets and represent the components which are included in the delay circuit 22' and the writing and reading addressing circuit 23' of the decrypter 2 and are identical to the circuits 12' and 13' of the encrypter 1. Reference will be made hereinafter to the encrypter, unless otherwise stated.

The input 120' of the first stage of the first delay line $121'_1$ receives continuously the initial analog signal. The delay line $121'_1$ samples the initial signal into N series analog samples at constant writing frequency $F_W$ during each period $NT_W$. The writing pulses at frequency $F_W$ are transmitted along wire $126'_1$ from the addressing circuit 13'. The end of each period $NT_W$ is detected by the dual monostable flip-flop 163 which opens N analog AND gates $122'_1$ to $122'_N$ (respectively $222'_1$ to $222'_N$ for the decrypter) at the time of the transmission of a synchronizing pulse along the wire 161 (respectively 261 for the decrypter). The other inputs of the gates $122'_1$ to $122'_N$ are connected to the outputs of N stage pairs of the first delay line $121'_1$ and simultaneously transmit in parallel N stored samples to the inputs of N stage pairs of the second delay line $121'_2$. At the beginning of each period $NT_W$, the delay line $121'_2$ operates in reading-out at instants $t_1$ to $t_N$ according to the predetermined time distribution of the selected code delivered from the addressing circuit 13', via the wire $126'_2$. The output 125' of the last stage of the delay line $121'_2$ produces the encrypted signal as for the first embodiment.

As seen from FIG. 6, the addressing circuit 13' of the encrypter is simpler. It comprises no more than the frequency divider 130 which delivers the signal $S_1$, the inverter 131 which delivers the signal $S_2$, and two AND gates such as $132_1$ and $133_1$. All these components are inter-connected in a similar way to that depicted in FIG. 3.

The writing gate $132_1$ of the circuit 13', 23' transmits along the wire $126'_1$ the writing pulses at the constant frequency $F_W$ which are supplied from the time base 14, via the wire 140, in the encrypter, respectively along the wire $226'_1$ at the instants $t_1$ to $t_N$ determined by the writing pulses which are supplied from the decrypting signal generator 25, via the wire 250, in the decrypter. The reading gate $133_1$ of the circuit 13', 23' transmits the reading pulses along the wire $126'_2$ at the instants $t_1$ to $t_N$ determined by the reading pulses which are supplied from the encrypting signal generator 15, via the wire 150, in the decrypter, respectively along the wire $226'_2$ at the constant frequency $F_W$ which are supplied from the time base 24, via the wire 240, in the decrypter.

It will be noted that, in practice, the recurrent code sequences of duration $NT_W$ are chosen, on the one hand, to obtain a totally unintelligible encrypted signal and, on the other, to restore the initial analog signal from the encrypted signal with a high signal/noise ratio, so that the listening quality of the decrypted signal is close to that of the intitial signal. The choice between the different arrangements of the two delay lines and also between the types of pulse modulator depends on utilization restrictions such as manufacturing cost of the decrypter which, unlike the encrypter, is produced in large quantities.

Although the invention has been particularly described and shown with reference to the preferred embodiments thereof, it will be understood by those skilled in the art that other changes relative to the structure of the encrypting and decrypting signal generators and the addressing circuits may be made therein without departing from the spirit and scope of the invention.

At least one of the generators 15 and 25, preferably the decrypting signal generator 25, may comprise only one pulse modulator or more simply one frequency multiplier or divider which is synchronized with a clock frequency. The latter circuit generates just one time distribution of instants $t_1$ to $t_N$ during a period $NT_W$ and may an integrated circuit which is plugged into the decrypter rack. It is turned on by a straight-forward initialization push-button replacing the keyboard. An advantage of this lies in its effectively controlling those who wish to listen to a predetermined program since the listener wishing to listen to or record this program will have to acquire such a circuit. In addition, this selection of the listeners can be made using decrypters including analog delay lines which comprise a predetermined number of stages lower than that of the encrypter delay lines which provides for a predetermined program to be received by decrypters having delay lines whose stage number is equal to that really utilized in the delay lines of the encrypter. Indeed, it is easy to select first stages of a delay line in the encrypter.

The transmission of the compound signal resulting from mixing the encrypted signal and the synchronizing signal in the encrypter can be performed, as already stated, by cable, Hertzian channel, optical fibres or an analogous communication medium. The initial analog signal can come within the radio-communication, television, or telephone field. When the encrypted signal is conveyed in a frequency channel of the communication medium 3, the synchronizing signal may be mixed with the encrypted signal in this channel, or may modulate an audio-frequency subcarrier wave, which is mixed with the encrypted signal, wherein the subcarrier is modulated in phase for example by the synchronizing signal. In the case of an initial analog signal to be encrypted which is transmitted by a video transmission system, the composite encrypted and synchronizing signal can be conveyed in a conventional television channel, or be time-division multiplexed with the video signal for example by appropriately inserting it into the line synchronizing and blanking signals and/or in the frame synchronizing and blanking signals.

Finally, it will be noted that any combination of encrypting means in accordance with the invention and known decrypting means thereby obtaining a encrypted signal from time compression and expansion of a constant-period sampled analog signal or a sampled analog signal whose samples have been periodically mixed beforehand by permutation or in keeping with any suitable sequence, also lies within the scope of the invention herein. The inverse rearrangement carried out by the corresponding decrypter also comes within the scope of this invention.

What we claim is:

1. An encrypting and decrypting system for encrypting an analog incoming signal into an analog encrypted signal and for decrypting said analog encrypted signal into an analog decrypted signal analogous to said incoming signal, said encrypting and decrypting system comprising:

first analog means receiving said incoming signal for time delaying 2 N analog samples of said incoming signal;

first writing means for producing first clock pulses at a predetermined period $F_W$ which control the writing and sampling operations of N successive samples of said incoming signal in said first time delaying means during a first period $NT_W$;

first reading means comprising pulse sequence producing means for producing an encrypting signal having N pulses per period equal to $NT_W$, said N encrypting signal pulses controlling the in series reading operation of said N successive samples of said incoming signal in said first time delaying means during a second period $NT_W$ following said first period thereby obtaining said analog encrypted signal and said N encrypting signal pulses being time distributed according to a predetermined distribution in each of said periods $NT_W$ thereby obtaining N encrypted signal samples having undergone at least a time compression and eventually a time expansion with regard to the regular time distribution of said N incoming signal delayed samples;

second analog means receiving said encrypted signal for time delaying 2 N analog samples of said encrypted signal;

second writing means comprising pulse sequence producing means for producing a decrypting signal synchronized with and identical to said encrypting signal, the N decrypting signal pulses controlling the writing operation of the N successive samples of said encrypted signal in said second time delaying means during said first period $NT_W$ and said N decrypting signal pulses being time distributed according to said predetermined distribution;

means for addressing said pulse sequence producing means in either said first reading means or in said second writing means thereby selecting an encrypting signal or a decrypting signal, each of said first reading means and said second writing means having means for periodically producing a sequence of pulses, the N first of which being said N encrypting signal pulses or said N decrypting signal pulses;

means for counting N pulses of said sequence during each period $NT_W$ of said encrypting or decrypting signal;

means controlling by said counting means for locking during each period $NT_W$ said reading operation in said first reading means or said writing operation in said second writing means after the $n^{th}$ pulse of said sequence until the start of the following period $NT_W$;

synchronizing means controlling by said locking means or receiving a synchronizing signal from said locking means of said first reading means for resetting to zero said counting means and for triggering said pulse sequence producing means; and second reading means for producing second clock pulses at said predetermined period $T_W$ which are synchronized with said first clock pulses and control the reading operation of the N successive encrypted signal samples in said second time delaying means during said period $NT_W$ thereby obtaining said analog decrypted signal.

2. An encrypting and decrypting system according to claim 1 wherein said pulse sequence producing means of said second writing means are interconnected to of said second writing means.

3. An encrypting and decrypting system according to claim 1 wherein at least one of said pulse sequence producing means is a frequency divider or multiplier which may be programmable by said addressing means.

4. An encrypting and decrypting system according to claim 3 wherein at least one of said pulse sequence producing means is a pulse modulator with a predetermined position modulation or a pulse modulator with a predetermined frequency modulation whose frequency may be programmable by said addressing means.

5. An encrypting and decrypting system according to claim 1 comprising:

means connected to said synchronizing means of said first reading means for modulating said synchronizing signal which identifies the end of each of said periods $NT_W$ of said encrypting signal;

means connected to said first time delaying means for filtering said encrypted signal;

means for filtering the modulated synchronizing signal;

means for mixing said encrypted signal and said modulated synchronizing signal into a mixed signal;

means for filtering said mixed signal into said encrypted signal which is delivered to said second time delaying means and said modulated synchronizing signal; and means for demodulating said synchronizing signal into said synchronizing signal which is delivered to said synchronizing means of said second writing means.

* * * * *